US006019571A

United States Patent [19]

Fischer

[11] Patent Number: 6,019,571

[45] Date of Patent: Feb. 1, 2000

[54] SIDE CHANNEL COMPRESSOR

[75] Inventor: Peter Fischer, Nürnberg, Germany

[73] Assignee: Siemens Aktiengesellschaft, München, Germany

[21] Appl. No.: 09/029,138

[22] PCT Filed: Sep. 2, 1996

[86] PCT No.: PCT/DE96/01626

§ 371 Date: Mar. 9, 1998

§ 102(e) Date: Mar. 9, 1998

[87] PCT Pub. No.: WO97/10439

PCT Pub. Date: Mar. 20, 1997

[30] Foreign Application Priority Data

Sep. 13, 1995 [DE] Germany ..... 195 33 922

[51] Int. Cl.[7] ..... F01D 1/12

[52] U.S. Cl. ..... 415/55.1; 415/55.2; 415/55.3; 415/55.4; 415/170.1; 415/173.1; 415/173.3; 415/173.4; 415/174.2; 415/174.3; 415/174.4; 277/402; 277/407; 277/946

[58] Field of Search ..... 415/55.1, 55.2, 415/55.3, 55.4, 170.1, 173.1, 173.3, 173.4, 174.2, 174.3, 174.4; 277/402, 407, 946

[56] References Cited

U.S. PATENT DOCUMENTS

| | | | |
|---|---|---|---|
| 4,221,390 | 9/1980 | Bainbridge | 277/12 |
| 4,806,073 | 2/1989 | Schonwald | 415/53 T |
| 5,143,511 | 9/1992 | Verneau et al. | 415/55.4 |
| 5,879,789 | 3/1999 | Dolan et al. | 428/212 |

*Primary Examiner*—Edward K. Look
*Assistant Examiner*—Matthew T. Shanley
*Attorney, Agent, or Firm*—Kenyon & Kenyon

[57] ABSTRACT

Side channel compressor, in which the gap (7) existing between the rotor (2) and the housing parts (1) surrounding the rotor (2) is sealed off using a sealing tape (8) introduced into a peripheral groove (9) provided in the corresponding wall regions of the housing parts (1). An impairment of the operability of the side channel compressor by a sealing tape attached to the housing is largely ruled out, in that the sealing tape (8) is held by a solidifying compound (10) which is introduced into groove widenings (11) provided at a plurality of points located in a distributed manner over the circumference of the peripheral groove (9) and which makes a positive connection with the sealing tape (8).

6 Claims, 3 Drawing Sheets

SIDE CHANNEL COMPRESSOR

This application has been filed under 35 U.S.C. 371 and claims foreign priority benefits under 35 U.S.C. 119 of PCT/DE96/01626, filed Sep. 2, 1996, which is based upon German patent application Serial#: 195 33 922.3, filed Sep. 13, 1995.

FIELD OF THE INVENTION

The invention relates to a side channel compressor in which a gap existing between a rotor and housing parts surrounding the rotor is sealed off using a sealing tape introduced into a peripheral groove provided in corresponding wall regions of the housing parts.

RELATED TECHNOLOGY

Such a side channel compressor is known from DE-A-22 44 933. In this known side channel compressor, a sealing tape is inserted into a groove of the housing cover, the said groove extending in each case transversely relative to the plane of the gap existing between the rotor and the housing. During the assembly of the side channel compressor, this sealing tape can be brought into its position by means of the rotor itself. The sealing tape is then fixed in this position in various ways, inter alia also by means of an adhesive or sealing compound. After the alignment of the sealing tape, the adhesive or sealing compound is introduced into the groove via corresponding perforations accessible from the outside. In this case, some of the compound may escape from the groove and bond with the rotor, with the result that the latter may jam and the compressor may not start up. Moreover, in the course of the operating time of the side channel compressor, the bond of the adhesive or sealing compound may come loose from the smooth wall face of the sealing tape.

SUMMARY OF THE INVENTION

The object on which the present invention is based is to develop a side channel compressor of the relevant generic type, in such a way that an impairment of the operability of the side channel compressor by a sealing tape attached to the housing is largely ruled out.

The present invention therefore provides a side channel compressor in which the sealing tape is held by a solidifying compound which is introduced into groove widenings provided at a plurality of points located in a distributed manner over the circumference of the peripheral groove and which makes a positive connection with the sealing tape. Since a solidifying compound is introduced only at a few points of the peripheral groove, the risk that the rotor will jam because too much compound has been introduced is virtually ruled out. A permanent retention of the sealing tape is afforded by the positive connection between the compound and the sealing tape.

If the groove widenings are designed as pocketlike widenings accessible from the inside of the housing parts, then the compound can be introduced only from inside the housing into this widening and consequently the escape of the compound out of these widenings can be observed and appropriately prevented.

The positive connection between the compound and the sealing tape is achieved in the simplest way using depressions which are provided on the sealing tape and into which the compound penetrates, or using elevations on the sealing tape which are embedded by the compound.

It is also advantageous to provide on the sealing tape bores or perforations which are at least partially filled with the compound and which thus ensure a satisfactory positive connection of the compound to the sealing tape. A material strip consisting of Teflon can be provided especially advantageously as sealing tape.

BRIEF DESCRIPTION OF THE DRAWINGS

The present invention is described in more detail below by depicting a plurality of portions of a side channel compressor which are represented in part cross-section. In the drawing.

DETAILED DESCRIPTION

Figure 1:
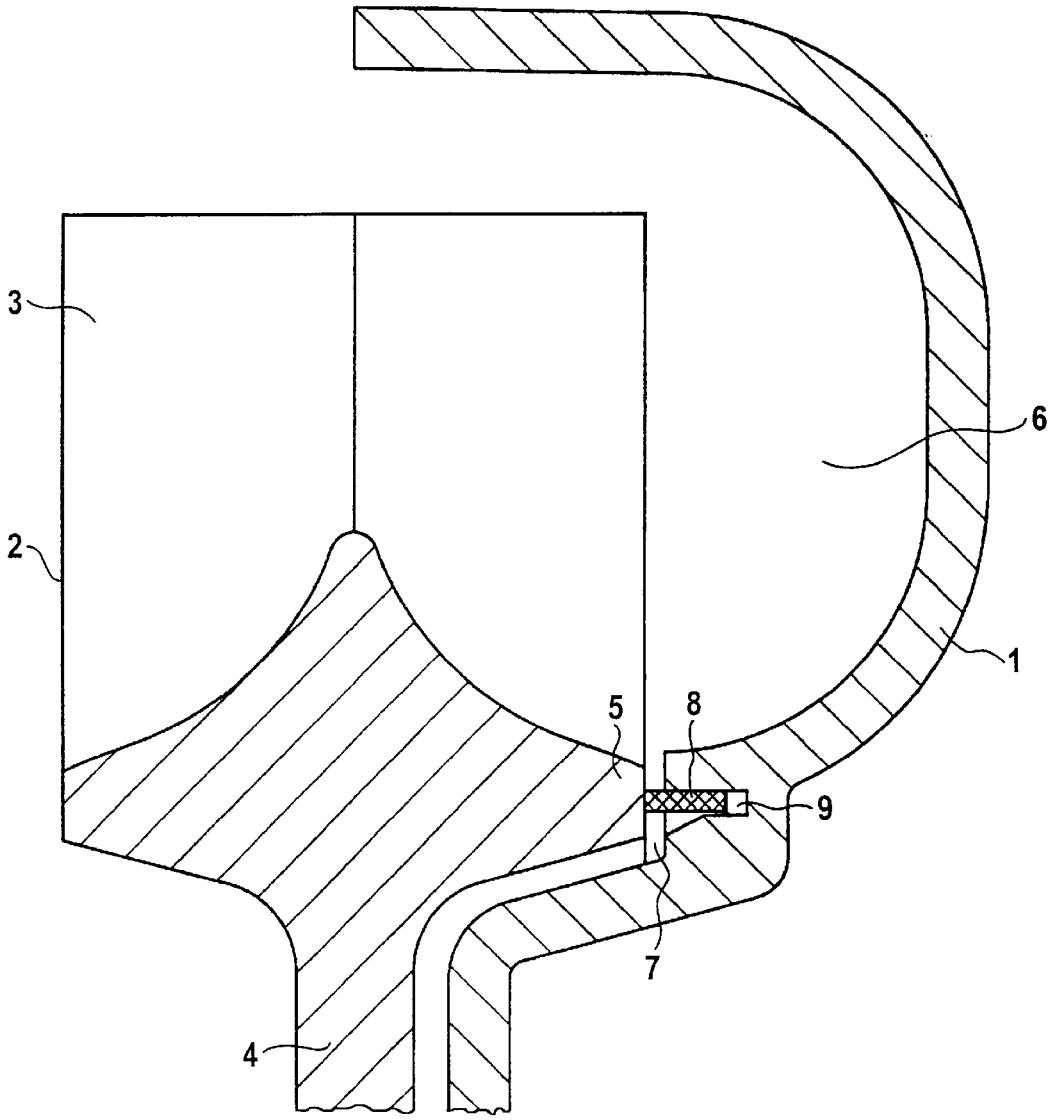
FIG. 1 shows a sealing arrangement in a side channel compressor with a non-fastened portion of the sealing tape.
Figure 2:
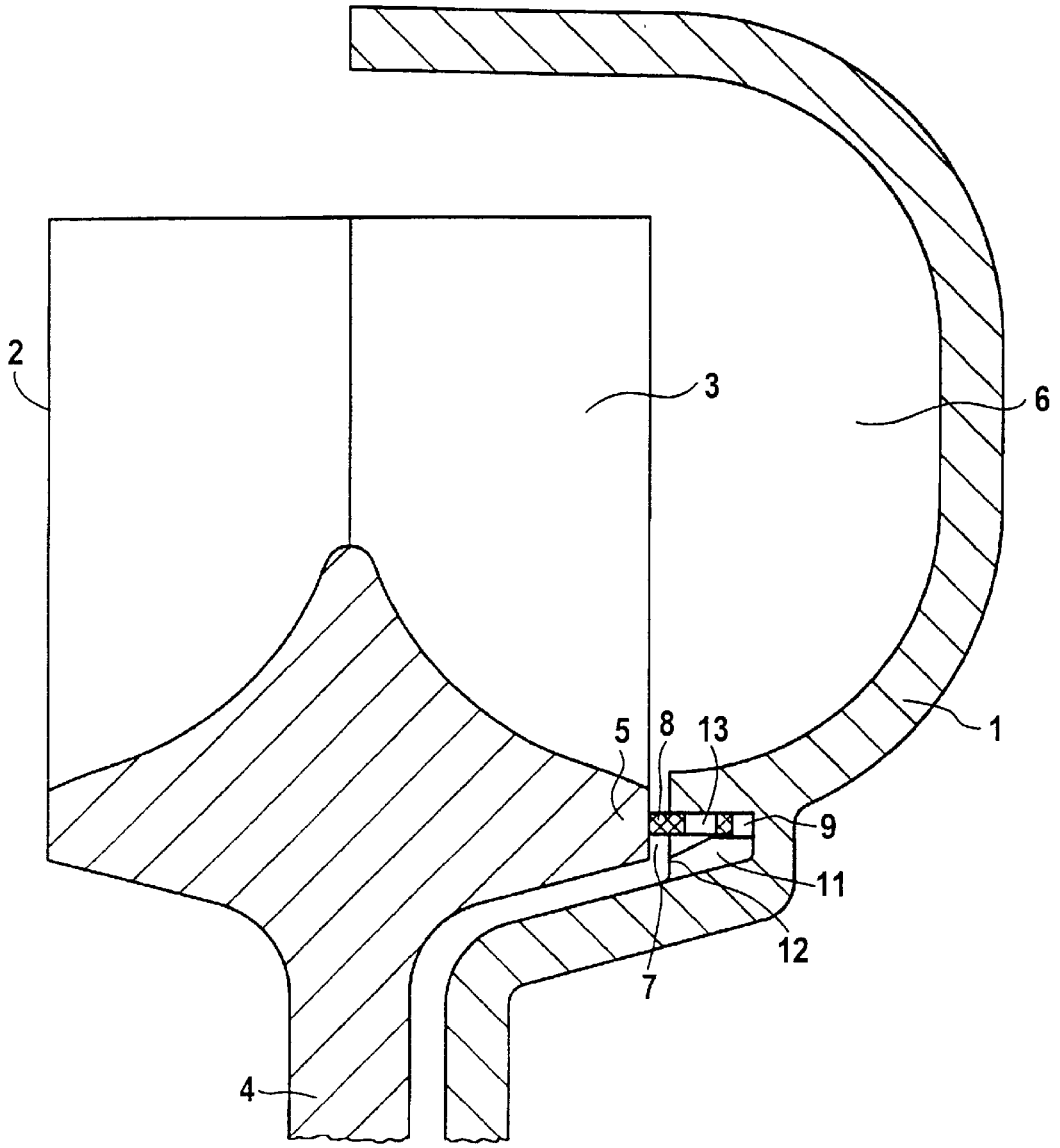
FIG. 2 shows a portion designed for fastening the sealing tape.
Figure 3:
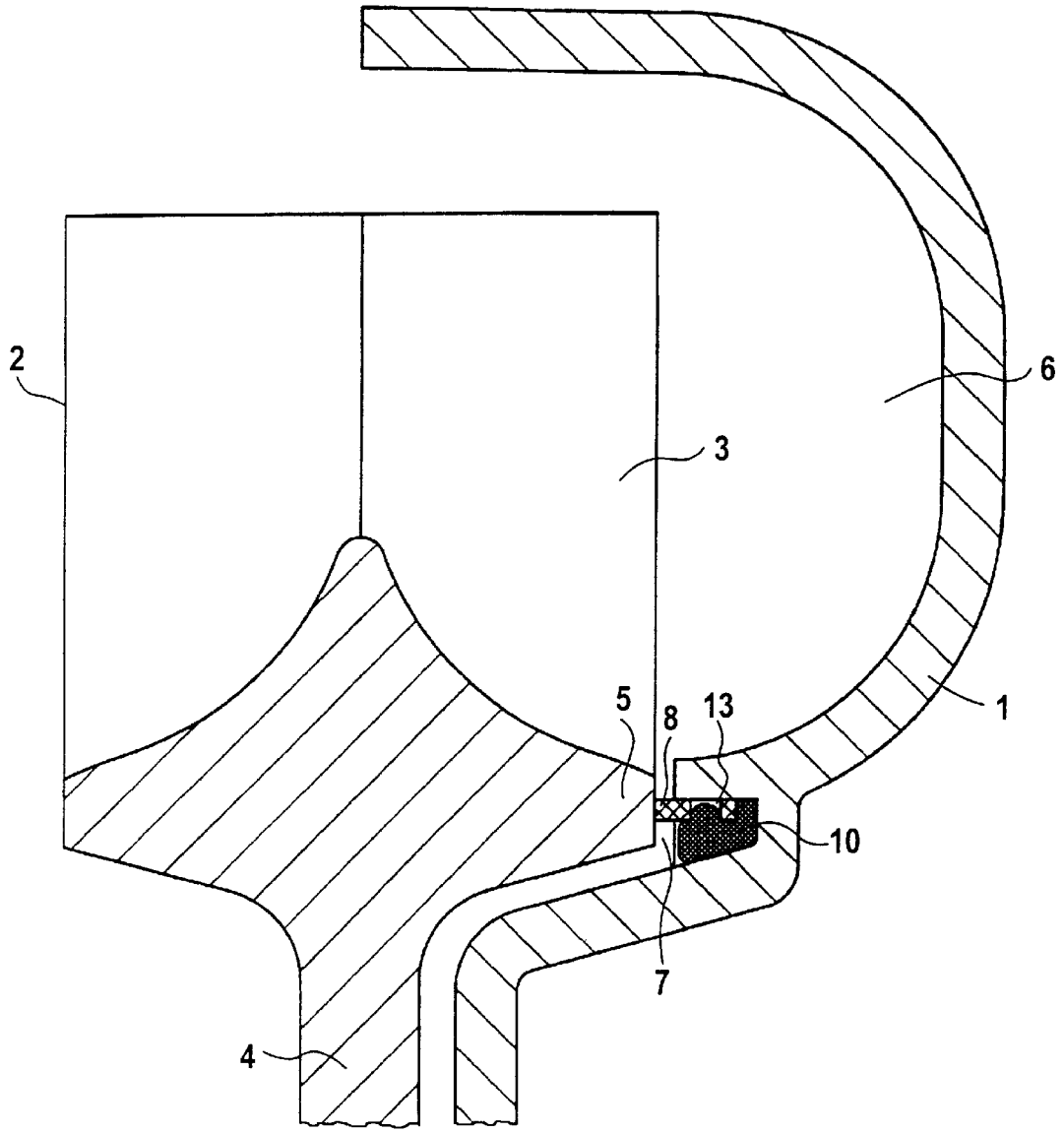
FIG. 3 shows the portion shown in FIG. 2, after the introduction of a solidifying compound.

With reference to FIGS. 1, 2 and 3, the number 1 denotes a housing half and number 2 the rotor of a side channel compressor. The rotor 2 has, in a known way, a base ring 5 fitted with feed vanes 3 and carried by the hub 4 of the rotor 2. A side channel 6 is formed on the housing half 1. The housing of the side channel compressor is completed by a further housing half not shown in the drawing and corresponding to the housing half 1. As a consequence of the mode of operation, a gap 7 exists between the housing halves and the rotor 2. Since this gap 7 extends over the entire circumference of the rotor and housing, in a side channel compressor a flow is established from the region of higher pressure to the region of lower pressure. The feed volume and consequently the efficiency of the side channel compressor are diminished as a result of this flow. In order as far as possible to prevent such a flow loss, the gap 7 is appropriately sealed off using a sealing arrangement.

This sealing arrangement comprises a sealing tape 8 which is inserted into a peripheral groove 9 formed opposite the base ring 5 of the rotor 2 in the respective housing half 1. The sealing tape 8 is retained using a compound 10 introduced into the peripheral groove 9 at a few points on the circumference of the latter. This compound 10 has the property of solidifying only to a particular degree, but not of hardening, that is to say the compound still has some elasticity in the solidified state. So that the compound 10 can easily be introduced into the peripheral groove 9, pocket-like widenings 11 are provided in the region of the peripheral groove 9 at the corresponding points. The opening side 12 of these widenings 11 is located on the inside of the respective housing half 1. The compound 10 can consequently be introduced into the peripheral groove 9 only from here, so that an escape of the compound 10 out of the peripheral groove 9 or the pocket-like widening 11 is noticed and any compound 10 which has escaped can be eliminated.

Provided in the sealing tape 8 are bores 13 which are arranged in the sealing tape 8 in such a way that, when the sealing tape 8 is inserted into the peripheral groove 9, they each come to rest in a pocket-like widening 11. When the compound 10 is being introduced into the pocket-like widening 11, some of the compound 10 penetrates into the bores 13 and fills these at least partially. This results in a positive connection between the compound 10 and the sealing tape 8, so that the latter is secured in the peripheral groove 9 by the compound 10.

Before the housing half 1 is assembled together with the rotor 2, the sealing tape 8 is inserted into the peripheral groove 9 and the compound 10 is introduced into the pocket-like widenings 11. Since the compound 10 is still soft at first, during the assembly of the housing halves 1 together with the rotor 2 the sealing tape 8 is correspondingly pressed into the peripheral groove 9 by the base ring 5 of the rotor 2, the said base ring butting against the said sealing tape. The sealing tape 8 thus bears flush on the base ring 5. The sealing tape 8 is held in this optimum sealing position by the gradually solidifying compound 10.

Since slight skew positions cannot be ruled out completely when the rotor 2 is being mounted on its drive shaft, corresponding wobbling movements occur during the rotation of the rotor 2. For this reason, the use of a material strip comprising of TEFLON as sealing tape is especially advantageous, since such a sealing tape 8 can grind itself in according to the wobbling movements and a good sealing effect is thus still maintained.

What is claimed is:

1. A side-channel compressor, comprising:

a rotor;

a housing surrounding the rotor, the housing being spaced from the rotor by a gap and having a peripheral groove, the peripheral groove having a plurality of groove widenings located in a distributed manner about a circumference of the peripheral groove, the groove widenings being pocket-like widenings accessible from an inside of the housing;

a sealing tape located in the gap and peripheral groove for sealing the gap; and a solidifying compound located in the plurality of groove widenings for creating a positive connection with the sealing tape.

2. The side-channel compressor as recited in claim 1 wherein the depressions are bores or perforations filled with the solidifying compound.

3. The side-channel compressor as recited in claim 1 wherein the sealing tape has depressions or elevations for interacting with the solidifying compound.

4. The side-channel compressor as recited in claim 3 wherein the depressions are bores or perforations filled with the solidifying compound.

5. The side-channel compressor as recited in claim 3 wherein the sealing tape is comprised of TEFLON.

6. The side-channel compressor as recited in claim 1 wherein the sealing tape is comprised of TEFLON.

* * * * *